US005872548A

United States Patent [19]

Lopez

[11] Patent Number: 5,872,548

[45] Date of Patent: Feb. 16, 1999

[54] SPACE/ANGLE DIVERSITY CONFIGURATIONS FOR CELLULAR ANTENNAS

[75] Inventor: Alfred R. Lopez, Commack, N.Y.

[73] Assignee: GEC-Marconi Hazeltine Corporation Electronic Systems Division, Greenlawn, N.Y.

[21] Appl. No.: 794,712

[22] Filed: Feb. 4, 1997

[51] Int. Cl.[6] ..... H01Q 1/12

[52] U.S. Cl. ..... 343/890; 343/892

[58] Field of Search ..... 343/799, 890, 343/891, 892, 700 MS; H01Q 1/12, 21/26

[56] References Cited

U.S. PATENT DOCUMENTS

| | | | |
|---|---|---|---|
| 3,579,244 | 5/1971 | Dempsey | 343/890 |
| 4,180,820 | 12/1979 | Johns | 343/890 |
| 4,317,122 | 2/1982 | Ben-Dov | 343/890 |
| 5,497,166 | 3/1996 | Mahnad | 343/890 |
| 5,534,882 | 7/1996 | Lopez | 343/891 |

*Primary Examiner*—Don Wong
*Assistant Examiner*—Tho Phan
*Attorney, Agent, or Firm*—Edward A. Onders; Kenneth P. Robinson

[57] ABSTRACT

Performance of multibeam cellular antenna systems is improved by use of space diversity in antenna placement and angle diversity in antenna alignment. Space/angle diversity is achieved on a single tower structure (20) by placement of eight antennas (B1–B8) in pairs at four spaced locations (I, II, III, IV) at the tower corners. Antennas are placed with an orthogonally directed pair at each location. For each orthogonal pair (e.g., B1 and B2 at location I) there is an antenna located at a different corner which is pointed between the orthogonal directions (e.g., B5 at location II). Antenna placement and alignment for achieving space/angle diversity in triangular tower configurations are also described.

17 Claims, 3 Drawing Sheets

SPACE/ANGLE DIVERSITY CONFIGURATIONS FOR CELLULAR ANTENNAS

RELATED APPLICATIONS (Not Applicable)

FEDERALLY SPONSORED RESEARCH (Not Applicable)

BACKGROUND OF THE INVENTION

This invention relates to multibeam antenna systems for cellular radio applications and, more particularly, to antenna placement for improved space/angle diversity. Use of various types of cellular radio systems is increasing. For reasons including overall cost and also antenna site availability, the effective coverage area of a given cellular site is increasingly important. For many applications, improvements in both coverage area and signal processing can be obtained by using a plurality of beams (e.g., eight beams) of relatively narrow beamwidth (e.g., about 45 degrees beamwidth) to provide omnidirectional coverage (i.e., 360 degrees in azimuth), instead of relying upon a single omnidirective antenna for such purpose.

For improved signal processing, with decreased loss of signal or blind spot degradation, space diversity in antenna placement has been employed in cellular antenna systems. Typically, this has been accomplished by physically displacing one group of antennas from another group, with both groups covering the same sector. Angle diversity, wherein antennas of a first group providing coverage of a sector are aimed at different azimuth angles than antennas of another group covering the same sector, has also been described for use alone or with space diversity placement.

In prior implementation of space diversity, groupings of antennas separated by 10 to 20 feet, omnidirectional antennas mounted on the sides of tower structures, or other less than optimum arrangements have been employed to achieve physical separation of antennas.

Objects of the present invention are, therefore, to provide new and improved cellular antenna systems enabling operation with improved space/angle diversity. Additional objects are to provide cellular antenna systems having one or more of the following characteristics or capabilities:

- improved space diversity operation with single mast antenna mounting;
- improved angle diversity operation with single mast antenna mounting;
- improved space/angle diversity with single mast antenna mounting.

SUMMARY OF THE INVENTION

In accordance with the invention, a cellular antenna system, providing omnidirectional coverage with improved space/angle diversity, includes the following. A support structure is arranged to position antennas at four successive locations (locations I, II, III and IV) spaced around a vertically extending axis. Eight antennas are mounted in pairs on the support structure, including at each location a pair of antennas pointing in nominally orthogonal directions. The eight antennas are arranged so that an antenna pointing between the orthogonal directions of each pair is mounted at a different one of the locations. Further, the antennas are arranged so that the pointing direction of each of the eight antennas differs by an integral multiple of 45 degrees from the pointing direction of each other antenna.

In a particular embodiment of a cellular antenna system with space/angle diversity, the support structure is rectangular in cross section with antenna mounting locations I, II, III and IV adjacent to corners thereof. The pair of antennas at each location is arranged with respective nominal pointing directions as follows: location I, 90 and zero degrees; Location II, 45 and −45 degrees; location III, −90 and 180 degrees; and location IV, −135 and 135 degrees. Alternatively, the support structure may be triangular in cross section, with three of the mounting locations adjacent to corners thereof and the other location adjacent a midpoint between two of the corners. Different pointing directions are provided for the triangular configuration.

For a better understanding of the invention, together with other and further objects, reference is made to the accompanying drawings and the scope of the invention will be pointed out in the accompanying claims.

DESCRIPTION OF THE INVENTION

Figure 1:
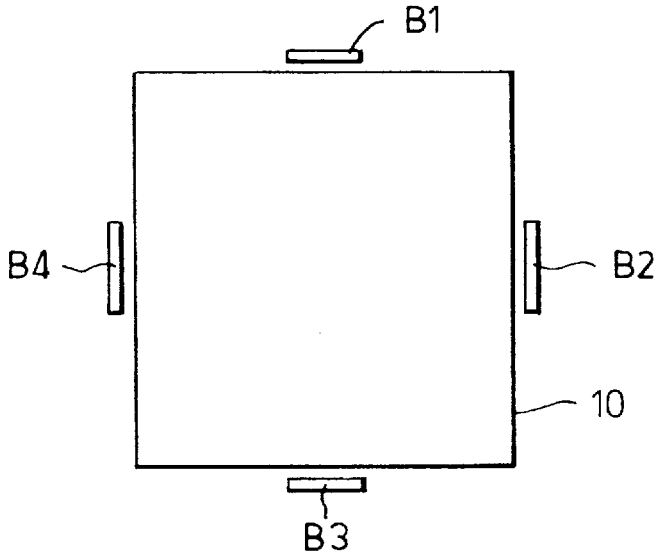
FIG. 1 shows a tower with four 90 degree antennas mounted to provide omnidirectional cellular coverage.
Figure 2:
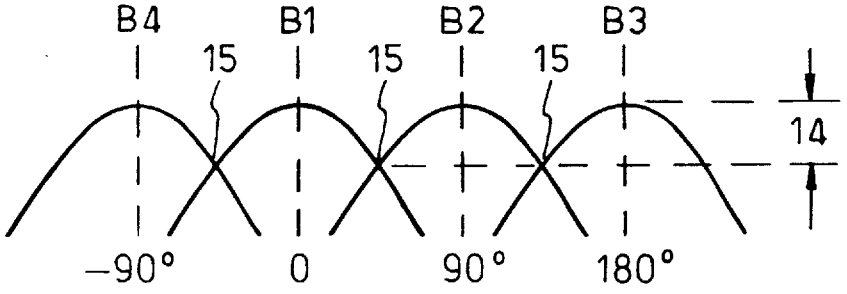
FIG. 2 illustrates the composite far field antenna pattern for four antennas providing omnidirectional coverage.

Referring now to FIG. 1, there is illustrated an antenna configuration capable of providing omnidirectional coverage. In FIG. 1, four antennas, each having a 90 degree beamwidth, are mounted on a tower 10 to provide omnidirectional coverage in azimuth. The antennas are identified on the basis of the beams they provide (i.e., B1, B2, B3, B4). As indicated in FIG. 2, beam center lines are positioned to provide beam peaks at 0, 90, 180 and −90 degrees azimuth. Lower gain beam crossover regions occur at 45 degree spacings between the beam peaks. The magnitude of the lower gain value at beam crossover 15 is represented at 14 in FIG. 2.

Figure 3:
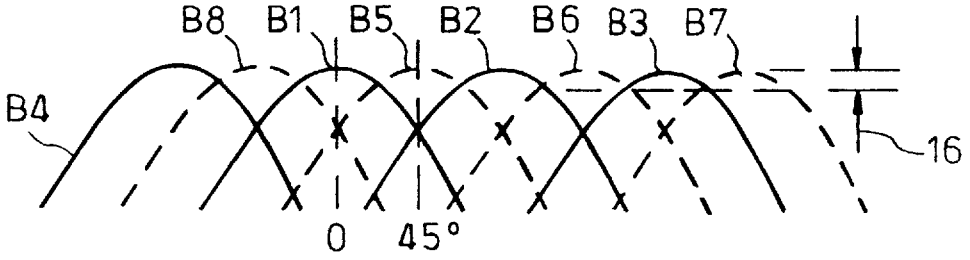
FIG. 3 illustrates the composite far field antenna pattern for two groups of four antennas providing superimposed coverage with angle diversity.

To provide space diversity, a second group of four similar antennas could be utilized, if the second group of antennas could be mounted on tower 10 at lateral separations of 10 to 20 feet from antennas B1–B4. Implementation of this spaced mounting objective pursuant to the invention will be described with reference to FIGS. 4 and 5. With respect to the resulting antenna patterns, if the antennas of the second group are mounted to similarly provide beam peaks at 0, 90, 180 and −90 degrees azimuth, the composite far field antenna pattern would still be as shown in FIG. 2, with the beams of the second group of antennas (e.g., beams B5–B8) superimposed on the beams of the FIG. 1 antennas (beams B1–B4). Alternatively, angle diversity can be provided in accordance with the disclosure of copending U.S. patent application Ser. No. 379,819, now U.S. Pat. No. 5,581,260 commonly assigned with the present application. As will be discussed with reference to FIGS. 4 and 5, implementation of angular diversity will result in the beams of the antennas of the second group (i.e., beams B5–B8) being shifted in azimuth by 45 degrees relative to beams B1–B4. As shown in FIG. 3, the antenna system gain (composite pattern strength) is thereby significantly improved in what had been the reduced gain value 14 at crossover regions 15 between adjacent ones of beams B1–B4, as discussed with reference to FIG. 2. With angle diversity, lower gain value 16, as exists between beams B3 and B7 for example, is smaller in magnitude as shown in FIG. 3.

The result would be that beams B1–B4 provide omnidirectional coverage, beams B5–B8 provide omnidirectional coverage and space diversity and, by employing angle diversity, the crossover regions of each group of beams is covered by the beams from antennas of the other group.

Figure 4:
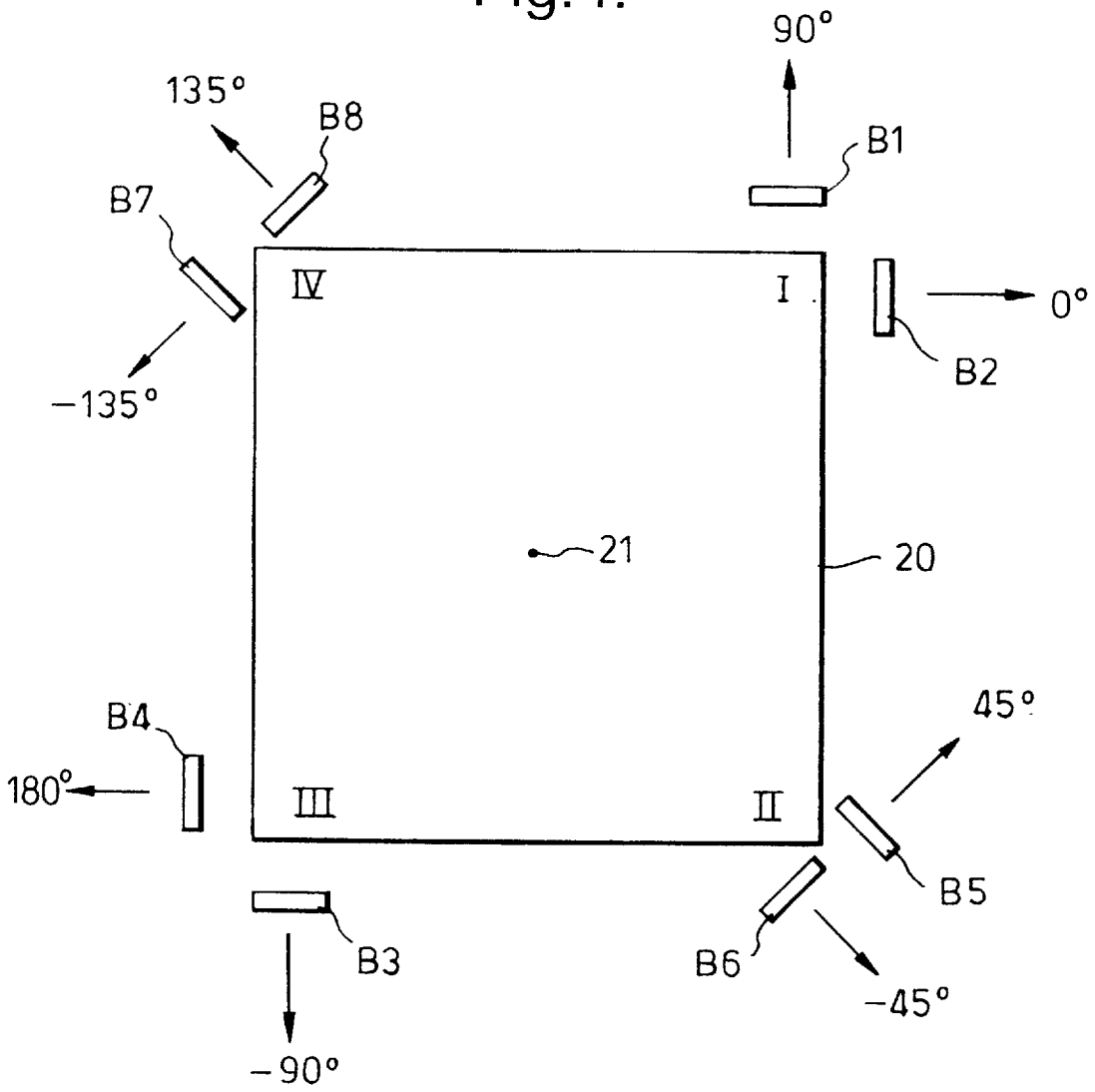
FIG. 4 shows an embodiment of a cellular antenna system utilizing the present invention, with eight antennas mounted on a single rectangular tower or other support structure.

With reference to FIG. 4, there is illustrated a cellular antenna system providing omnidirectional coverage with improved space/angle diversity in accordance with the invention. In FIG. 4 a single support structure 20 is arranged to position eight antennas B1–B8 at four successive locations around the structure 20, which has a vertically extending axis 21. The word "successive" is used to indicate that the four locations, which may be identified for purposes of reference as locations I, II, III and IV, are at successively greater angle separations from a starting point (proceeding clockwise in this example). The term "vertically extending" is used to indicate that axis 21 extends primarily vertically, even though it may be inclined from vertical in a particular application. Support structure 20 of FIG. 4 may be a rectangular tower, free standing or mounted on a building as an antenna mast, or other suitable support arrangement.

In FIG. 4, eight antennas B1–B8 are mounted on support structure 20. As shown, a pair of antennas is mounted at each of locations I, II, III and IV. The antennas are mounted so that at each location there is a pair of antennas pointing in nominally orthogonal directions. The word "nominally" is used to indicate that an angle, or relationship referred to will typically be within plus or minus ten percent of the stated angle or relationship. Thus, in FIG. 4, at location I, antennas B1 and B2 point in orthogonal directions 90 and zero degrees, respectively. Also, at location II, antennas B5 and B6 point in the orthogonal directions 45 and −45 degrees; at III, antennas B3 and B4 point at −90 and 180 degrees; and at IV, antennas B7 and B8 point at −135 and 135 degrees.

In addition to being mounted in orthogonal pairs, the FIG. 4 antennas are arranged with an antenna pointing between such orthogonal directions mounted at a different one of the locations I, II, III and IV. For example, antennas B1 and B2 point in orthogonal directions 90 and zero degrees from location I. Antenna B5 has a pointing direction between such orthogonal directions (i.e., 45 degrees) and is mounted at a different location (i.e., location II). Similarly, for the pair of antennas mounted at each of locations II, III and IV, there is an antenna mounted at a different location which has a pointing direction between the orthogonal directions of the co-located pair of antennas (e.g., antenna B7 at location IV, for co-located orthogonal pair B3 and B4). Also, as shown the pointing direction of each of the eight antennas B1–B8 differs by an integral multiple of 45 degrees from the pointing direction of each other antenna.

It will thus be appreciated that in the FIG. 4 arrangement both space diversity and angle diversity are achieved by use of eight antennas mounted on a common support structure. Angle diversity is achieved by arranging antennas B1–B4 to provide omnidirectional coverage and arranging antennas B5–B8 to also provide omnidirectional coverage, but with beams shifted 45 degrees in azimuth. Space diversity is provided by mounting the antennas so that each of antennas B5, B6, B7 and B8 is mounted at a location different from the location of the two antennas of the first group B1–B4 which have beams adjacent in azimuth to it (e.g., antenna B5 at location II and antennas B1 and B2 at location I, antenna B6 at location II and antennas B2 and B3 at locations I and III, etc.)

Other pointing directions will meet the antenna mounting/pointing constraints set out above. For example, with antennas B1–B8 mounted at the locations shown in FIG. 4, respective pointing directions may alternatively be provided as follows for the antennas: B1, 67.5°; B2, −22.5°; B3, −112.5°; B4, 157.5°; B5, 22.5°; B6, −67.5°; B7, −157.5°; B8, 112.5°. The pointing directions of the preceding sentence result in maximum clearance of the radiated antenna beams, relative to beam obstruction by the illustrated support structure itself. With these pointing directions and the mounting locations of antennas B1–B8 shown in FIG. 4 both space and angle diversity will again be achieved. Thus, by the relatively slight rotation of the antennas B1–B8 of FIG. 4 to provide this different set of pointing directions, the additional benefit of minimizing physical blockage of the radiated beams is achieved.

Figure 5:
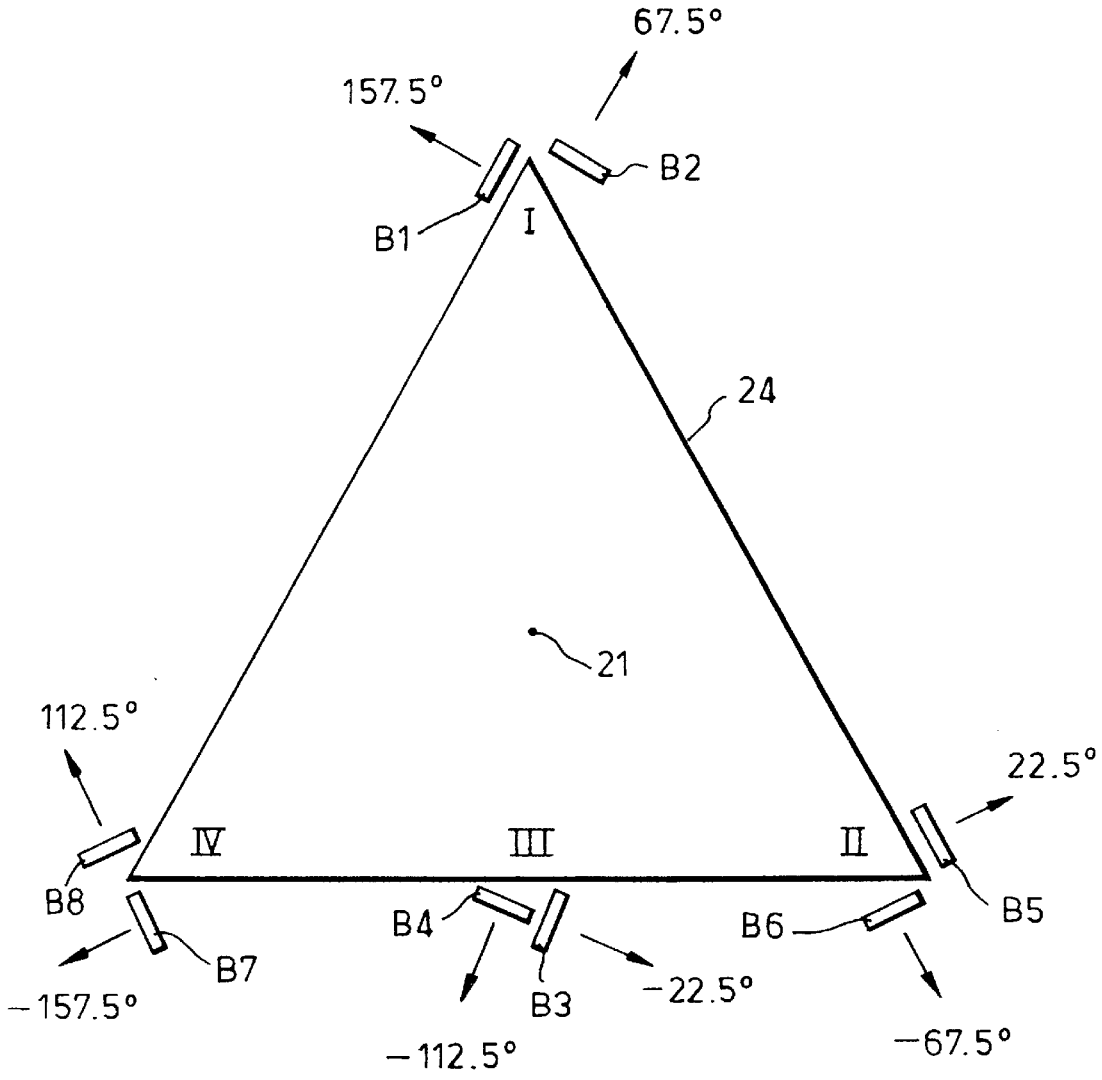
FIG. 5 shows an embodiment of a cellular antenna system utilizing the present invention, with eight antennas mounted on a single triangular tower or other support structure.

Referring now to FIG. 5, there is illustrated a triangular antenna mounting configuration providing omnidirectional coverage by antennas B1–B4 and azimuth-shifted omnidirectional coverage by antennas B5–B8. Both space diversity and angle diversity operation are achieved as described with reference to FIG. 4. As shown in FIG. 5, support structure 21 is a tower or other suitable structure basically of triangular form around vertically extending axis 21. Three of the antenna mounting locations (i.e., I, II, IV) are adjacent successive corners of the support structure and the fourth mounting location (i.e., III) is adjacent a midpoint between two corners. In FIG. 5, the eight antennas B1–B8 are mounted so that the respective pairs of antennas at each location have orthogonal pointing directions as follows: corner location I, 157.5° and 67.5°; corner location II, 22.5° and 67.5°; midpoint location III, −22.5° and −112.5°; and corner location IV, −157.5° and 112.5°.

Other pointing directions can be used with the FIG. 5 antenna mounting configuration, while still meeting the mounting/pointing constraints described above and thereby providing both space and angle diversity operation. For maximum clearance of the radiated antenna beams relative to obstruction by the illustrated support structure, the FIG. 5 antennas can be relatively slightly rotated to the following respective pointing directions: B1, 142.5°; B2, 52.5°; B3, −37.5°; B4, −127.5°; B5, 7.5°; B6, −82.5°; B7, −172.5°; B8, 97.5°. It will be appreciated that actual beam clearance is dependent upon the particular configuration of the support structure, whether basically square, rectangular, triangular, octagonal, hexagonal, or other, and whether the antennas are mounted close to the structure or extended outward on mounting brackets, etc.

With an understanding of the configurations of eight antennas as discussed above, skilled persons will be enabled to apply the invention to other antenna systems. More specifically, for a cellular antenna system providing omnidirectional coverage with improved space/angle diversity, a support structure can be arranged to position a desired number of antennas in pairs at successive locations around a vertically extending axis. With reference to FIG. 4, for example, a plurality of N antennas are mounted on the support structure 20, including (a) mounted at each location a pair of antennas (e.g., B1 and B2) respectively pointing in two different directions separated by an angle (e.g., 90 degrees) and (b) for each such pair of antennas, an antenna at a different location (e.g., B5) with a pointing direction nominally bisecting the angle. The angle between each pair of antennas at a location will nominally be equal to 360 degrees divided by one-half of N. Thus, with antennas B1 and B2 pointed respectively at 90 and zero degrees azimuth, antenna B5 is pointed at the bisecting angle of 45 degrees, as shown in FIG. 4.

While there have been described the currently preferred embodiments of the invention, those skilled in the art will recognize that other and further modifications may be made without departing from the invention and it is intended to claim all modifications and variations as fall within the scope of the invention.

What is claimed is:

1. A cellular antenna system, providing onmidirectional coverage with improved space/angle diversity, comprising:

a support structure to position antennas at four successive laterally separated locations (locations I, II, III and IV) spaced around a vertically extending axis, said locations being at non-adjacent positions with lateral separations selected to provide space diversity operation;

eight antennas, including mounted at each said location a pair of antennas pointing in nominally orthogonal directions, and for each said pair an antenna at a different said location with a pointing direction between said orthogonal directions;

the pointing direction of each of said eight antennas differing nominally by an integral multiple of 45 degrees from the pointing direction of each other said antenna.

2. A cellular antenna system as in claim 1, wherein each of said eight antennas is of the same design and has a 3 dB beamwidth of nominally 90 degrees, to provide improved maximum/minimum gain characteristics.

3. A cellular antenna system as in claim 1, wherein said antennas comprise a first group of four antennas mounted in pairs at locations I and III and having different respective pointing directions at 90 degree increments, and a second group of four antennas mounted in pairs at locations II and IV and having different respective pointing directions at 90 degree increments, the pointing directions of the two groups of antennas differing by increments of 45 degrees.

4. A cellular antenna system, providing omnidirectional coverage with improved space/angle diversity, comprising:

a support structure to position antennas at successive laterally separated locations spaced around a vertically extending axis, said locations being at non-adjacent positions with lateral separations selected to provide space diversity operation; and a plurality of N antennas, including mounted at each said location a pair of antennas respectively pointing in two different directions separated by an angle, and for each said pair an antenna at a different said location with a pointing direction nominally bisecting said angle;

said angle nominally equal to 360 degrees divided by one-half N.

5. A cellular antenna system, providing omnidirectional coverage with improved space/angle diversity, comprising:

a support structure to position antennas at successive laterally separated locations spaced around a vertically extending axis, said locations being at non-adjacent positions with lateral separations selected to provide space diversity operation; and a plurality of N antennas, including two antennas mounted at each said location, with the pointing direction of each antenna differing nominally from the pointing direction of each other antenna by an integral multiple of 360 degrees divided by N;

the antennas arranged so that for each pair of antennas respectively pointing in directions separated by an angle nominally equal to 360 degrees divided by one-half N, there is an antenna at a location different from the location of each antenna of said pair having a pointing direction nominally bisecting said angle.

6. A cellular antenna system as in claim 5, wherein said plurality of N antennas consists of eight antennas, all of the same design.

7. A cellular antenna system as in claim 6, wherein each of said eight antennas has a 3 dB beamwidth of nominally 90 degrees.

8. A cellular antenna system, providing omnidirectional coverage with improved space/angle diversity, comprising:

a support structure to position antennas at four successive laterally separated locations (locations I, II, III and IV) spaced around a vertically extending axis, said support structure being one of rectangular and triangular in cross section and at least three of said locations being adjacent to corners of the support structure; and eight antennas, including mounted at each said location a pair of antennas pointing in nominally orthogonal directions, and for each said pair an antenna at a different said location with a pointing direction between said orthogonal directions;

the pointing direction of each of said eight antennas differing nominally by an integral multiple of 45 degrees from the pointing direction of each other said antenna.

9. A cellular antenna system as in claim 8, wherein said support structure is rectangular in cross section and said locations are adjacent to corners thereof.

10. A cellular antenna system as in claim 8, wherein said support structure is rectangular in cross section with said locations adjacent to corners thereof, and the pair of antennas at each location has respective nominal pointing directions as follows: location I, 90 and zero degrees; location II, 45 and −45 degrees; location III, −90 and 180 degrees; and location IV, −135 and 135 degrees.

11. A cellular antenna system as in claim 8, wherein said support structure is rectangular in cross section with said locations adjacent to corners thereof, and the pair of antennas at each location has respective nominal pointing directions as follows: location I, 67.5 and −22.5 degrees; location II, 22.5 and −67.5 degrees; location III, −112.5 and 157.5 degrees; and location IV, −157.5 and 112.5 degrees.

12. A cellular antenna system as in claim 8, wherein said support structure is triangular in cross section and three of said locations are adjacent to corners thereof and the other location is adjacent a midpoint between two of said corners.

13. A cellular antenna system as in claim 8, wherein said support structure is triangular in cross section with three of said locations adjacent to corners thereof and the other location adjacent a midpoint between two of said corners, and the pair of antennas at each location has respective nominal pointing directions as follows: corner location I, 157.5 and 67.5 degrees; corner location II, 22.5 and −67.5 degrees; corner location IV, −157.5 and 112.5 degrees; and location III, midpoint between locations II and IV, −22.5 and −112.5 degrees.

14. A cellular antenna system as in claim 8, wherein said support structure is triangular in cross section with three of said locations adjacent to corners thereof and the other location adjacent a midpoint between two of said corners, and the pair of antennas at each location has respective nominal pointing directions as follows: corner location I, 142.5 and 52.5 degrees; corner location II, 7.5 and −82.5 degrees; corner location IV, −172.5 and 97.5 degrees; and location III, midpoint between locations II and IV, −37.5 and −127.5 degrees.

15. A cellular antenna system, providing omnidirectional coverage with improved space/angle diversity, comprising:

a support structure to position antennas at successive laterally separated locations spaced around a vertically extending axis, said support structure being one of rectangular and triangular in cross section and at least three of said locations being adjacent to corners of the support structure; and a plurality of N antennas, including two antennas mounted at each said location, with the pointing direction of each antenna differing nominally from the pointing direction of each other antenna by an integral multiple of 360 degrees divided by N;

the antennas arranged so that for each pair of antennas respectively pointing in directions separated by an angle nominally equal to 360 degrees divided by one-half N, there is an antenna at a location different from the location of each antenna of said pair having a pointing direction nominally bisecting said angle.

16. A cellular antenna system as in claim 15, wherein said support structure is rectangular in cross section, said locations consist of four locations, and said locations are adjacent to corners thereof.

17. a cellular antenna system as in claim 15, wherein said support structure is triangular in cross section, said locations consist of four locations, and three of said locations are adjacent to corners thereof and the other location is adjacent a midpoint between two of said corners.

* * * * *